US007947753B2

(12) United States Patent
Greer, Jr.

(10) Patent No.: US 7,947,753 B2
(45) **Date of Patent: *May 24, 2011**

(54) PARTICULATE MATERIALS FOR ACOUSTIC TEXTURE MATERIAL

(75) Inventor: Lester R. Greer, Jr., New York, NY (US)

(73) Assignee: Homax Products, Inc., Bellingham, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/982,134

(22) Filed: Oct. 31, 2007

(65) Prior Publication Data

US 2008/0128203 A1 Jun. 5, 2008

Related U.S. Application Data

(63) Continuation of application No. 11/027,219, filed on Dec. 29, 2004, now Pat. No. 7,374,068.

(60) Provisional application No. 60/617,236, filed on Oct. 8, 2004.

(51) Int. Cl.
*C08J 9/00* (2006.01)

(52) U.S. Cl. ..... 521/78; 521/50

(58) Field of Classification Search ..... 521/78
See application file for complete search history.

(56) References Cited

U.S. PATENT DOCUMENTS

| | | | |
|---|---|---|---|
| 2,686,652 | A | 8/1954 | Carlson et al. |
| 2,763,406 | A | 9/1956 | Countryman |
| 2,764,454 | A | 9/1956 | Edelstein |
| 2,785,926 | A | 3/1957 | Lataste |
| 2,831,618 | A | 4/1958 | Soffer et al. |
| 2,839,225 | A | 6/1958 | Soffer et al. |
| 2,965,270 | A | 12/1960 | Soffer et al. |
| 3,191,809 | A | 6/1965 | Schultz et al. |
| 3,196,819 | A | 7/1965 | Lechner et al. |
| 3,346,195 | A | 10/1967 | Groth |
| 3,415,425 | A | 12/1968 | Knight et al. |
| 3,433,391 | A | 3/1969 | Krizka et al. |
| 3,450,314 | A | 6/1969 | Gross |
| 3,467,283 | A | 9/1969 | Kinnavy |
| 3,482,738 | A | 12/1969 | Bartels |
| 3,544,258 | A | 12/1970 | Presant et al. |
| 3,548,564 | A | 12/1970 | Bruce et al. |
| 3,592,359 | A | 7/1971 | Marraffino |
| 3,700,136 | A | 10/1972 | Ruekberg |

(Continued)

FOREIGN PATENT DOCUMENTS

DE 3806991 A 9/1989

OTHER PUBLICATIONS

Homax Brochure, Easy Touch Spray Texture, Mar. 1992.

*Primary Examiner* — Mark Eashoo
*Assistant Examiner* — Jane L Stanley
(74) *Attorney, Agent, or Firm* — Michael R. Schacht; Schacht Law Office, Inc.

(57) ABSTRACT

A composition for forming a textured coating on drywall material, comprising acoustic texture material and propellant material. The acoustic texture material comprises a base portion and a particulate portion, where the particulate portion comprises at least one of urethane foam and melamine foam. The propellant material is at least one of DME and a hydrocarbon propellant.

6 Claims, 3 Drawing Sheets

U.S. PATENT DOCUMENTS 3,788,521 A 1/1974 Laauwe
3,806,005 A 4/1974 Prussin et al.
3,828,977 A 8/1974 Borchert
3,862,705 A 1/1975 Beres et al.
3,913,842 A 10/1975 Singer
3,938,708 A 2/1976 Burger
3,989,165 A 11/1976 Shaw et al.
3,992,003 A 11/1976 Visceglia et al.
4,010,134 A * 3/1977 Braunisch et al. ..... 252/62
4,032,064 A 6/1977 Giggard
4,036,673 A 7/1977 Murphy et al.
4,045,860 A 9/1977 Winckler
4,089,443 A 5/1978 Zrinyi
4,117,951 A 10/1978 Winckler
4,148,416 A 4/1979 Gunn-Smith
4,154,378 A 5/1979 Paoletti et al.
RE30,093 E 9/1979 Burger
4,171,757 A 10/1979 Diamond
4,185,758 A 1/1980 Giggard
4,187,959 A 2/1980 Pelton
4,198,365 A 4/1980 Pelton
4,238,264 A 12/1980 Pelton
4,293,353 A 10/1981 Pelton et al.
4,308,973 A 1/1982 Irland
4,322,020 A 3/1982 Stone
4,346,743 A 8/1982 Miller
4,370,930 A 2/1983 Strasser et al.
4,401,271 A 8/1983 Hansen
4,401,272 A 8/1983 Merton et al.
4,411,387 A 10/1983 Stern et al.
4,417,674 A 11/1983 Giuffredi
4,442,959 A 4/1984 Del Bon et al.
4,641,765 A 2/1987 Diamond
4,854,482 A 8/1989 Bergner
4,870,805 A 10/1989 Morane
4,896,832 A 1/1990 Howlett
4,940,171 A 7/1990 Gilroy
4,949,871 A 8/1990 Flanner
4,955,545 A 9/1990 Stern et al.
4,961,537 A 10/1990 Stern
4,969,577 A 11/1990 Werding
5,007,556 A 4/1991 Lover
5,037,011 A 8/1991 Woods
5,038,964 A 8/1991 Bouix
5,059,187 A 10/1991 Sperry et al.
5,069,390 A 12/1991 Stern et al.
5,115,944 A 5/1992 Nikolich
5,126,086 A 6/1992 Stoffel
5,188,263 A 2/1993 Woods
5,188,295 A 2/1993 Stern et al.
5,211,317 A 5/1993 Diamond et al.
5,310,095 A 5/1994 Stern et al.
5,341,970 A 8/1994 Woods
5,409,148 A 4/1995 Stern et al.
D358,989 S 6/1995 Woods
5,421,519 A 6/1995 Woods
5,450,983 A 9/1995 Stern et al.
5,476,879 A 12/1995 Woods
5,489,048 A 2/1996 Stern et al.
5,505,344 A 4/1996 Woods
5,524,798 A 6/1996 Stern et al.
5,645,198 A 7/1997 Stern et al.
5,655,691 A 8/1997 Stern et al.
5,715,975 A 2/1998 Stern et al.
5,727,736 A 3/1998 Tryon
5,921,446 A 7/1999 Stern
5,934,518 A 8/1999 Stern et al.
6,000,583 A 12/1999 Stern et al.
6,095,435 A 8/2000 Greer, Jr. et al.
6,116,473 A 9/2000 Stern et al.
6,152,335 A 11/2000 Stern et al.
6,168,093 B1 1/2001 Greer, Jr. et al.
6,276,570 B1 8/2001 Stern et al.
6,328,185 B1 12/2001 Stern et al.
6,352,184 B1 3/2002 Stern et al.
6,446,842 B2 9/2002 Stern et al.
6,536,633 B2 3/2003 Stern et al.
6,641,005 B1 11/2003 Stern et al.
6,659,312 B1 12/2003 Stern et al.
7,014,073 B1 3/2006 Stern et al.
7,192,985 B2 3/2007 Woods
2004/0099697 A1 5/2004 Woods

* cited by examiner

PARTICULATE MATERIALS FOR ACOUSTIC TEXTURE MATERIAL

RELATED APPLICATIONS

This application is a continuation of U.S. patent application Ser. No. 11/027,219 filed Dec. 29, 2004, now U.S. Pat. No. 7,374,068, issued May 20, 2008, which claims priority of U.S. Provisional Patent Application Serial No. 60/617,236 filed Oct. 8, 2004. The contents of all related applications listed above are incorporated herein by reference.

TECHNICAL FIELD

The present invention relates to particulate materials for use in acoustic texture material and, more particularly, to particulate materials that may be used in acoustic texture material formulated to be dispensed from aerosol dispensers.

BACKGROUND OF THE INVENTION

Interior walls are formed by sheets of drywall material that are secured to the framing of a building. The seams between adjacent sheets of drywall material are taped, mudded, and sanded to obtain a substantially flat, smooth drywall surface. The drywall surface is coated with primer and paint to obtain a finished surface.

In some situations, a separate texture layer is applied to the drywall surface prior to painting. The texture layer is formed by spraying texture material onto the drywall surface. Texture material is a coating material that, when sprayed, does not form a smooth, thin coating. Instead, texture material is applied in discrete drops or globs that dry to form a bumpy, irregular textured surface.

Texture materials can be applied using any one of a number of application systems. During new construction, texture materials are commonly applied in a stream of compressed air using commercial hopper gun systems. For touch up or repair, texture material is commonly applied using hand operated pneumatic pumps or aerosol dispensing systems. Varying the parameters of the application system varies the size and spacing of the bumps to vary the look of the textured surface.

One specific form of texture material is commonly referred to as "acoustic" or "popcorn" texture material. In addition to a coating material, acoustic texture material further comprises an aggregate material. When the acoustic texture material is applied using commercial hopper guns, the aggregate material is conventionally formed by polystyrene chips. However, as will be described in detail below, chips made of polystyrene foam are dissolved by hydrocarbon aerosol propellant materials.

Accordingly, aerosol dispensing systems for dispensing small amounts of acoustic texture material for repair or touch-up purposes use one of two approaches. The first approach is to mix a liquid hydrocarbon aerosol propellant material with chips made from materials other than polystyrene. However, when chips made of materials other than polystyrene foam are used, the appearance and function of the texture surface may be different from that of the surrounding surface.

The second approach is to combine polystyrene chips with a propellant material formed by a pressurized inert gas such as nitrogen or air. This second approach allows the use of a conventional acoustic texture material including polystyrene chips. However, the use of a pressurized inert gas causes the acoustic texture material to be dispensed very quickly. The use of pressurized inert gas as a propellant can make it difficult for a non-professional to control the application of the acoustic texture material.

The need thus exists for improved systems and methods for dispensing small quantities of acoustic texture material for the purpose of touch-up or repair.

SUMMARY OF THE INVENTION

The present invention may be embodied as a composition for forming a textured coating on drywall material, comprising acoustic texture material and propellant material. The acoustic texture material comprises a base portion and a particulate portion, where the particulate portion comprises at least one of urethane foam and melamine foam. The propellant material is at least one of DME and a hydrocarbon propellant.

DETAILED DESCRIPTION OF THE INVENTION

Figure 1:
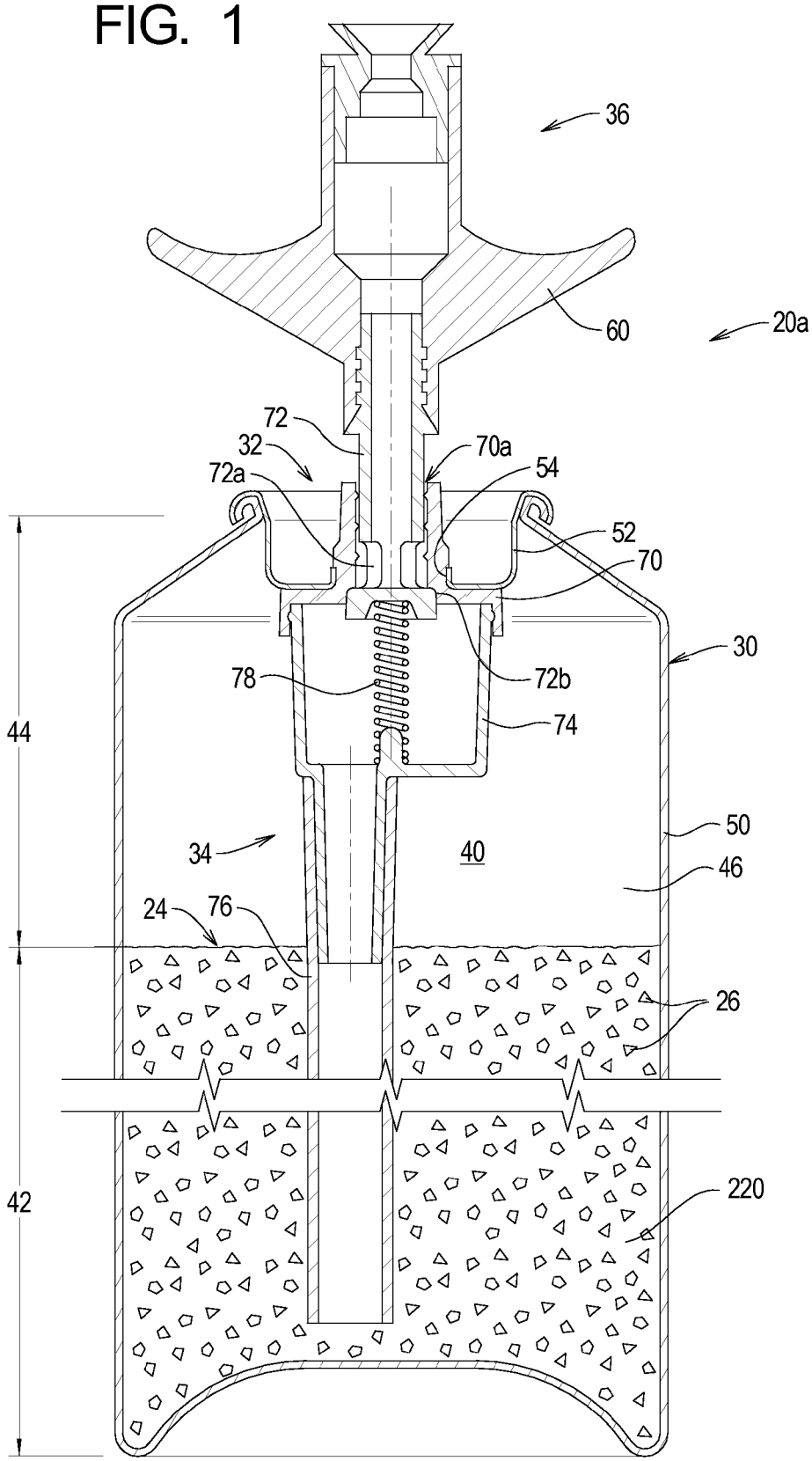
FIG. 1 is a section view of a first embodiment of an aerosol dispensing system containing acoustic texture material incorporating particulate material of the present invention.
Figure 4:
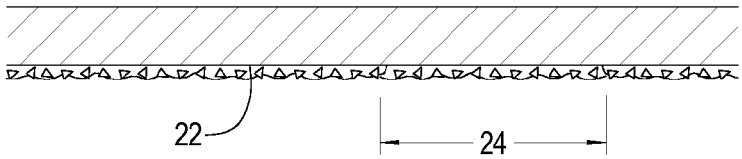
FIG. 4 is a section view of the acoustic texture material after it has been deposited on the surface.
Figure 5:
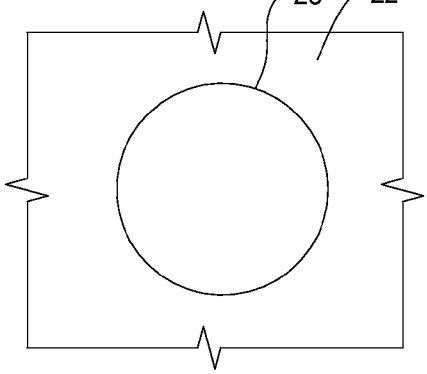
FIGS. 5 and 6 are bottom plan views of the surface before and after the acoustic texture material has been deposited thereon.

Referring initially to FIG. 1 of the drawing, depicted at 20*a* therein is a first embodiment of an aerosol system for depositing on a surface 22 (FIGS. 3-6) acoustic texture material 24 incorporating particulate material 26 of the present invention. FIG. 5 illustrates a target portion 28 of the surface 22 on which acoustic texture material 24 is to be deposited.

The example aerosol system 20*a* comprises a container assembly 30, a valve assembly 32, a collection assembly 34, and an outlet assembly 36. The container 30 defines a product chamber 40 in which the acoustic texture material 24 comprising the particulate material 26 is contained. A first portion 42 of the chamber 40 is occupied by the acoustic texture material 24, while a second portion 44 of the chamber 40 is occupied by a pressurized propellant material 46. The example container assembly 30 comprises a can member 50 and a cup member 52.

The valve assembly 32 is mounted in a cup opening 34 define by the cup member 52 and operates in a closed configuration (shown) and an open configuration. In the open configuration, the valve assembly 32 defines a dispensing passageway that allows fluid communication between the interior and the exterior of the container assembly 30.

The outlet assembly 36 comprises an actuator member 60 that causes acoustic texture material 24 to be dispensed by the system 20 in a fan shaped spray as will be described in further detail below. The actuator member 60 is mounted on the valve assembly 32 such that displacing the outlet member 60 towards the valve assembly 32 places the valve assembly in the open configuration.

The example valve assembly 32 comprises a valve seat 70, a valve stem 72, a valve housing 74, a dip tube 76, and a valve spring 78. The valve seat 70 defines a seat opening 70*a* and is supported by the cup member 52. The valve stem 72 defines a valve stem opening 72*a* and a valve surface 72*b*. The valve stem 72 is supported by the valve seat 70 such that the valve stem moves within the valve stem opening 72*a* between first and second positions, with the first position being shown in FIG. 1.

The valve housing 74 is supported by the valve seat 70 within the product chamber 40. The valve housing 74 further supports the dip tube 76 such that the acoustic texture material 24 within can flow into the valve housing 74 when the can is upright. The valve spring 78 is supported by the valve housing 74 such that the spring 78 biases the valve stem 72 into the first position. The valve stem 72 supports the outlet assembly 36 such that depressing the actuator member 60 towards the cup member 52 forces the valve stem 72 into the second position (not shown) against the force of the valve spring 78.

The valve assembly 32 thus operates in the closed configuration and the open configuration as follows. When no force is applied to the actuator member 60, the valve spring 78 forces the valve surface 72*b* against the valve seat 70 to prevent fluid from flowing through the valve stem opening 72*a*. When a force is applied to the actuator member 60, the valve surface 72*b* is forced away from the valve seat 70 such that fluid can flow from the interior of the valve housing 74 through the valve stem opening 72*a* and thus out of the product chamber 40.

Figure 2:
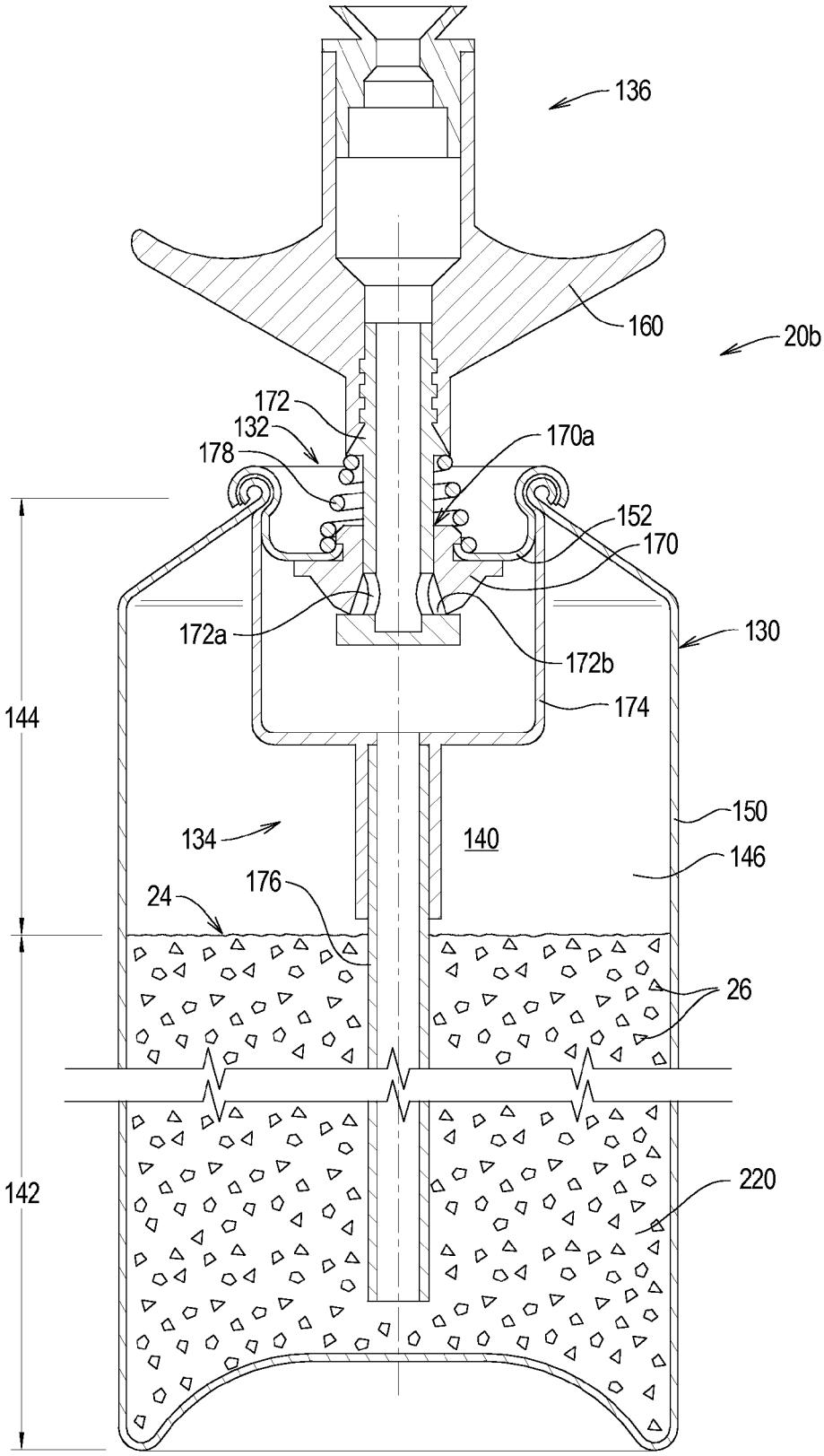
FIG. 2 is a section view of a second embodiment of an aerosol dispensing system containing acoustic texture material incorporating particulate material of the present invention.

Referring now to FIG. 2 of the drawing, depicted at 20*b* therein is a first embodiment of an aerosol system that may also be used to deposit the acoustic texture material 24 incorporating particulate material 26 of the present invention on the target portion 28 of the surface 22.

The example aerosol system 20*b* comprises a container assembly 130, a valve assembly 132, a collection assembly 134, and an outlet assembly 136. The container 130 defines a product chamber 140 in which the acoustic texture material 24 comprising the particulate material 26 is contained. A first portion 142 of the chamber 140 is occupied by the acoustic texture material 24, while a second portion 144 of the chamber 140 is occupied by a pressurized propellant material 146. The example container assembly 130 comprises a can member 150 and a cup member 152.

The valve assembly 132 is mounted in a cup opening 134 define by the cup member 152 and operates in a closed configuration (shown) and an open configuration. In the open configuration, the valve assembly 132 defines a dispensing passageway that allows fluid communication between the interior and the exterior of the container assembly 130.

The outlet assembly 136 comprises an actuator member 160 that causes acoustic texture material 24 to be dispensed by the system 20 in a fan shaped spray as will be described in further detail below. The actuator member 160 is mounted on the valve assembly 132 such that displacing the outlet member 160 towards the valve assembly 132 places the valve assembly in the open configuration.

The example valve assembly 132 comprises a valve seat 170, a valve stem 172, a valve housing 174, a dip tube 176, and a valve spring 178. The valve seat 170 defines a seat opening 170*a* and is supported by the cup member 152. The valve stem 172 defines a valve stem opening 172*a* and a valve surface 172*b*. The valve stem 172 is supported by the valve seat 170 such that the valve stem moves within the valve stem opening 172*a* between first and second positions, with the first position being shown in FIG. 1.

The valve housing 174 is supported by the valve seat 170 within the product chamber 140. The valve housing 174 further supports the dip tube 176 such that the acoustic texture material 124 within can flow into the valve housing 174 when the can is upright. The valve spring 178 is supported by the valve housing 174 such that the spring 178 biases the valve stem 172 into the first position. The valve stem 172 supports the outlet assembly 136 such that depressing the actuator member 160 towards the cup member 152 forces the valve stem 172 into the second position (not shown) against the force of the valve spring 178.

The valve assembly 132 thus operates in the closed configuration and the open configuration as follows. When no force is applied to the actuator member 160, the valve spring 178 forces the valve surface 172*b* against the valve seat 170 to prevent fluid from flowing through the valve stem opening 172*a*. When a force is applied to the actuator member 160, the valve surface 172*b* is forced away from the valve seat 170 such that fluid can flow from the interior of the valve housing 174 through the valve stem opening 172*a* and thus out of the product chamber 140.

Turning now to FIGS. 3-6, the use of the aerosol dispensing systems 20*a* and 20*b* will now be described in further detail. These dispensing systems 20*a* and 20*b* are used in the same manner and are both identified by reference character 20 in FIGS. 3-6.

Figure 3:
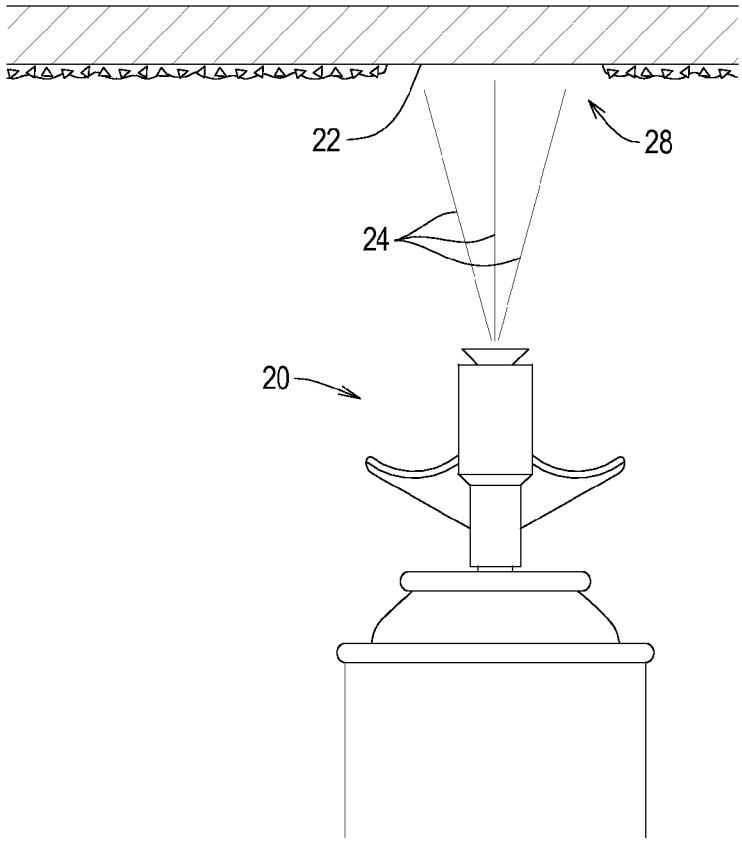
FIG. 3 is an elevation view depicting the use of one or both of the first and second aerosol dispensing systems of FIGS. 1 and 2 being used to deposit acoustic texture material to a surface.
Figure 6:
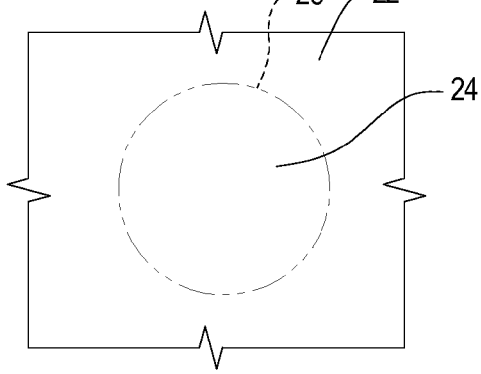

As shown in FIG. 3, the dispensing system 20 deposits a fan-shaped spray of acoustic texture material 24 on the target portion 28 of the wall 22. As shown in FIGS. 4 and 6, the acoustic texture material 24 covers the target portion 28 to match the pre-existing acoustic texture material on the surface 22 surrounding the target portion 28.

Referring for a moment back to FIGS. 1 and 2, it can be seen that, in addition to the particulate material 26, the acoustic texture material comprises a base portion 220 in the form of a flowable liquid. The base portion 220 of the particulate material conventionally comprises a carrier, a filler, and a binder.

In some aerosol systems, the propellant material 46,146 is simply an inert pressurized gas such as air or nitrogen. In other aerosol systems, the propellant material 46,146 is a material, referred to herein as bi-phase propellant material, that exists in both gaseous and liquid phases within the container assembly 30,130. The liquid phase of the propellant material 46,146 forms a part of the base portion 220, while the gaseous phase propellant material 46,146 occupies the pressurized portion 44 of the container assembly 30,130.

As the acoustic texture material 24 is dispensed, the pressure within the pressurized portion 44,144 of the container assemblies 30,130 drops. Under these conditions, a portion of the bi-phase propellant material 46,146 in the liquid phase gasifies to re-pressurize the pressurized portion 44,144 of the container assembly 30,130. The pressure within the pressurized portion 44,144 is thus under most conditions sufficient to force the acoustic texture material 24 out of the container assembly 30,130 along the dispensing passageway when the valve assembly 32,132 is in the open configuration. The propellant material 46,146 may thus be a pressurized inert gas such as air or nitrogen.

However, the present invention is of particular significance when the propellant material is a bi-phase propellant material such as di-methyl ethylene (DME) or any one of a number of hydrocarbon propellants such as those available in the industry as A-40 and A-70. The advantage of using bi-phase propellant materials is that the pressure within the pressurized portion 44,144 of the container assembly 30,130 is kept at a relatively constant, relatively low level as the level of acoustic texture material 24 drops. This constant, low level pressure allows the texture material 24 to be dispensed in many small bursts instead of in a few large bursts, as is the case when pressurized inert gases are used as the propellant material 46,146.

Many particulate materials 26 suitable for use in acoustic texture materials are incompatible with bi-phase propellant materials. For example, as described above polystyrene chips are commonly used in acoustic texture materials dispensed using commercial hopper guns. However, polystyrene chips dissolve in the bi-phase propellant materials of which the Applicant is aware.

The Applicant has discovered that urethane foam materials and melamine foam materials may be used as the particulate material 26 with bi-phase propellant materials such as DME and hydrocarbon propellants such as A-40 and A-70. Melamine foam materials in particular are easily chopped up using conventional material processors (e.g., a food blender) into irregular shapes that match the appearance and function of polystyrene chips. Melamine foam materials are already commonly used in building applications and have desirable fire retardant, thermal, and acoustic properties.

To manufacture the acoustic texture material 24, the base portion 220 may be the same as a conventional base used in commercially available acoustic texture materials. Instead of polystyrene chips, however, urethane and/or melamine foam is chopped up into particles of an appropriate size and use as the particulate. In addition, a bi-phase propellant material is used to form part of the carrier portion of the base portion 220.

The Applicant has thus determined that a conventional base portion using melamine foam chips and DME as a propellant is commercially practical and obtains acceptable aesthetic and functional results. Appropriate adjustments in the liquids used as the carrier in a conventional acoustic texture material formulation may be required to obtain a desired consistency of the acoustic texture material 24 as it is deposited on the surface 22.

What is claimed is:

1. A composition for forming a textured coating on drywall material, where the textured coating substantially matches a pre-existing acoustic texture material on the drywall material, comprising:

acoustic texture material comprising a base portion and a particulate portion, where the base portion is a flowable liquid disposed within a product chamber defined by an aerosol assembly, and the particulate portion comprises discrete, visible particles of solidified urethane foam distributed throughout the base portion within the product chamber; and propellant material disposed within the product chamber, where the propellant material is DME.

2. A composition as recited in claim 1, in which the particulate portion further comprises discrete, visible particles of solidified melamine foam.

3. A composition for forming a textured coating on drywall material, where the textured coating substantially matches a pre-existing acoustic texture material on the drywall material, comprising:

acoustic texture material comprising a base portion and a particulate portion, where the base portion is a flowable liquid disposed within a product chamber defined by an aerosol assembly, and the particulate portion comprises discrete, visible particles of solidified urethane foam distributed throughout the base portion within the product chamber; and propellant material disposed within the product chamber, where the propellant material is a hydrocarbon propellant.

4. A composition as recited in claim 3, in which the particulate portion further comprises discrete, visible particles of solidified melamine foam.

5. A composition for forming a textured coating on drywall material, where the textured coating substantially matches a pre-existing acoustic texture material on the drywall material, comprising:

acoustic texture material comprising a base portion and a particulate portion, where the base portion is a flowable liquid disposed within a product chamber defined by an aerosol assembly, and the particulate portion comprises discrete, visible particles of solidified melamine foam distributed throughout the base portion within the product chamber; and propellant material disposed within the product chamber, where the propellant material is DME.

6. A composition for forming a textured coating on drywall material, where the textured coating substantially matches a pre-existing acoustic texture material on the drywall material, comprising:

acoustic texture material comprising a base portion and a particulate portion, where the base portion is a flowable liquid disposed within a product chamber defined by an aerosol assembly, and the particulate portion comprises discrete, visible particles of solidified melamine foam distributed throughout the base portion within the product chamber; and propellant material disposed within the product chamber, where the propellant material is a hydrocarbon propellant.

* * * * *